US008382507B2

(12) United States Patent
Yamaguchi et al.

(10) Patent No.: US 8,382,507 B2
(45) Date of Patent: Feb. 26, 2013

(54) CONNECTORS FOR ELECTRIC CORDS

(75) Inventors: Hiroshi Yamaguchi, Anjo (JP); Kazuma Oshima, Anjo (JP); Shinichi Nakane, Anjo (JP)

(73) Assignee: Makita Corporation, Anjo-shi (JP)

( * ) Notice: Subject to any disclaimer, the term of this patent is extended or adjusted under 35 U.S.C. 154(b) by 273 days.

(21) Appl. No.: 12/787,516

(22) Filed: May 26, 2010

(65) Prior Publication Data

US 2010/0323550 A1 Dec. 23, 2010

(30) Foreign Application Priority Data

Jun. 18, 2009 (JP) ..... 2009-145268

(51) Int. Cl.
*H01R 13/62* (2006.01)

(52) U.S. Cl. ..... 439/369; 439/346

(58) Field of Classification Search ..... 439/350–358, 439/369, 346, 266
See application file for complete search history.

(56) References Cited

U.S. PATENT DOCUMENTS

| | | | | | |
|---|---|---|---|---|---|
| 3,350,675 | A | * | 10/1967 | Misencik et al. | 439/346 |
| 3,611,255 | A | * | 10/1971 | Shroyer | 439/352 |
| 4,403,824 | A | * | 9/1983 | Scott | 439/680 |
| 4,725,240 | A | * | 2/1988 | Braverman | 439/105 |
| 4,875,874 | A | * | 10/1989 | Windsor, Jr. | 439/369 |
| 4,900,262 | A | * | 2/1990 | Matsuzaki | 439/354 |
| 4,961,711 | A | * | 10/1990 | Fujiura et al. | 439/357 |
| 5,069,634 | A | * | 12/1991 | Chiarolanzio | 439/353 |
| 5,096,436 | A | * | 3/1992 | Noschese | 439/352 |
| 5,352,132 | A | * | 10/1994 | O'Keefe et al. | 439/346 |
| 5,470,239 | A | * | 11/1995 | Rancourt | 439/654 |
| 5,885,098 | A | * | 3/1999 | Witkowski | 439/369 |
| 5,893,772 | A | * | 4/1999 | Carmo et al. | 439/346 |
| 5,921,798 | A | * | 7/1999 | Ursich | 439/346 |
| 6,022,237 | A | * | 2/2000 | Esh | 439/348 |
| 6,080,004 | A | * | 6/2000 | Kovacik et al. | 439/369 |
| 6,231,358 | B1 | * | 5/2001 | Kerr et al. | 439/140 |
| 6,454,576 | B1 | * | 9/2002 | Hedrick et al. | 439/105 |
| 6,863,555 | B2 | * | 3/2005 | Ito | 439/353 |
| 7,108,538 | B2 | * | 9/2006 | Ratzlaff et al. | 439/346 |
| 7,232,349 | B1 | * | 6/2007 | Chen | 439/810 |
| 7,306,483 | B2 | * | 12/2007 | Phillips et al. | 439/568 |
| 7,347,708 | B1 | * | 3/2008 | Huang | 439/346 |

(Continued)

FOREIGN PATENT DOCUMENTS

| | | |
|---|---|---|
| JP | 03-046565 | 4/1991 |
| JP | 04-069871 | 6/1992 |
| JP | 05-029026 | 2/1993 |
| JP | B2-3051768 | 6/2000 |
| JP | B2-3082680 | 8/2000 |
| JP | 2005-169525 | 6/2005 |

OTHER PUBLICATIONS

Jan. 8, 2013 Office Action issued in Japanese Patent Application No. 2009-145268 w/translation.

*Primary Examiner* — Briggitte R Hammond
(74) *Attorney, Agent, or Firm* — Oliff & Berridge, PLC

(57) ABSTRACT

An electrical connection device includes a first connector and a second connector capable of being mechanically and electrically connected to the first connector. A lock mechanism can lock the connection between the first and second connectors. The first connector has a cover capable of covering a connecting region between the first and second connectors. The second connector has an unlock device operable to unlock the lock mechanism. The unlock device is positioned not to interact with the cover when the first and second connectors are connected to each other.

17 Claims, 3 Drawing Sheets

U.S. PATENT DOCUMENTS

| | | | | |
|---|---|---|---|---|
| 7,484,986 | B1 * | 2/2009 | Wu | 439/346 |
| 7,744,400 | B2 * | 6/2010 | Carmitchel | 439/369 |
| 7,758,371 | B2 * | 7/2010 | Carmitchel | 439/363 |
| 2002/0094712 | A1 * | 7/2002 | Cheung | 439/346 |
| 2002/0115353 | A1 * | 8/2002 | Zeiler et al. | 439/660 |
| 2002/0182922 | A1 * | 12/2002 | Rosa et al. | 439/352 |

* cited by examiner

CONNECTORS FOR ELECTRIC CORDS

This application claims priority to Japanese patent application serial number 2009-145268, the contents of which are incorporated herein by reference.

BACKGROUND OF THE INVENTION

1. Field of the Invention

The present invention relates to connectors for electric cords that are suitably used as connectors of extension cords extended from power cords of power tools used mainly outdoors, such as gardening tools including bush cutters and hedge trimmers.

2. Description of the Related Art

In general, a power cord of a gardening tool is designed to have a length (about 30 cm) not to interact with a blade in order to prevent the power cord from being damaged by the blade. Thus, because the power cord is very short, it is necessary to connect an extension cord with the power cord for supplying electric power when the gardening tool is used outdoors. Various improvements have been conventionally made to plugs (hereinafter called "male connectors" on a side of a power cord and connectors (hereinafter called "female connectors") on a side of an extension cord. For example, in order to improve waterproof performance at a connecting portion between the male and female connectors, a cover portion is provided on the side of the male connector for covering the connecting portion.

Further, a technique has been proposed for preventing the male and female connectors from being easily unplugged, in which a connection fixing member having hooks on opposite sides is attached extending between the power cord and the extension cord, while a string is wound around and between the hook on the male connector side and the hook on the female connector side so that male and female connectors may not be easily disconnected, for example, even in the case that the extension cord has been accidentally stepped on.

However, because this hook-type connection fixing member has a problem in resulting low workability and increase in cost as it cannot be easily attached to the cord and the string cannot be easily wounded. For this reason, there has been proposed a female connector having a lock mechanism. U.S. Pat. No. 7,484,986, Japanese Patent No. 3051768 and Japanese Patent No. 3082680 disclose a technique concerning a female connector with a lock mechanism. According to this lock-type connector, because the connection can be locked by a lock mechanism when a male connector is inserted and connected, the connection condition can be more easily and reliably maintained compared to the above hook-type fixing member. Therefore, it may improve the workability (to enable quick gardening work) and reduce the cost because no any additional members, such as a fixing member, are required.

However, the known female connectors with the conventional lock mechanisms still have various problems. The female connector with the lock mechanism as disclosed above U.S. Pat. No. 7,484,986 cannot be applied to a male connector with a connecting cover portion. Normally, the connecting cover portion on the side of the male connector extends to such a position that the connecting terminals may not be projected outward the connecting cover portion. If the connection cover portion is configured to provide a connecting depth that is too deep compared with the insertion allowance of the female connector, an end portion of the connecting cover portion may interfere with an unlock button of the lock mechanism. As a result, a waterproof function of the connecting cover portion may be impaired or a function of the lock mechanism may be impaired if the unlock button is inadvertently pressed. For these reasons, the known female connector with the lock mechanism is difficult to be applied to an extension cord for connection with a power cord of a gardening tool.

Further, a look mechanism disclosed in Japanese Laid-Open Patent Publication No. 4-292885 (U.S. Pat. No. 3,051,768) requires a lock claw provided to one of male and female connectors and an engaging portion provided to the other of the connectors to be engaged with the lock claw. Therefore, it lacks versatility.

Moreover, a lock mechanism disclosed in Japanese Laid-Open Patent Publication No. 10-92512 (U.S. Pat. No. 3,082,680) is not designed to be used to a male connector with a connecting cover portion and cannot be applied as a connector lock mechanism for an extension cord used for extending a power cord of a gardening tool.

Therefore, there is a need in the art for a connecting device that can ensure performance of functions of a connection cover and a look mechanism.

SUMMARY OF THE INVENTION

An electrical connection device includes a first connector and a second connector capable of being mechanically and electrically connected to the first connector. A look mechanism can lock the connection between the first and second connectors. The first connector has a cover capable of covering a connecting region between the first and second connectors. The second connector has an unlock device operable to unlock the lock mechanism. The unlock device is positioned not to interact with the cover when the first and second connectors are connected to each other.

DETAILED DESCRIPTION OF THE INVENTION

Figure 1:
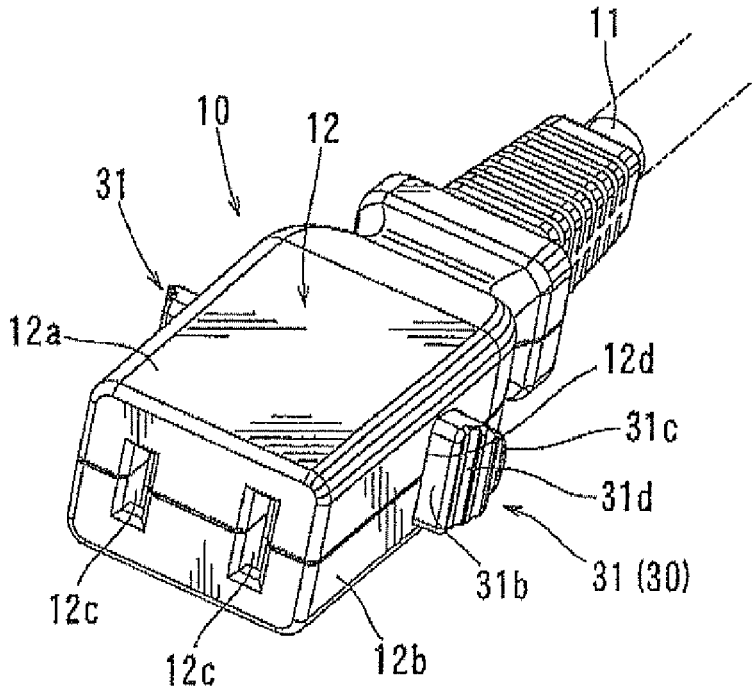
FIG. 1 is a perspective view of a female connector.
Figure 2:
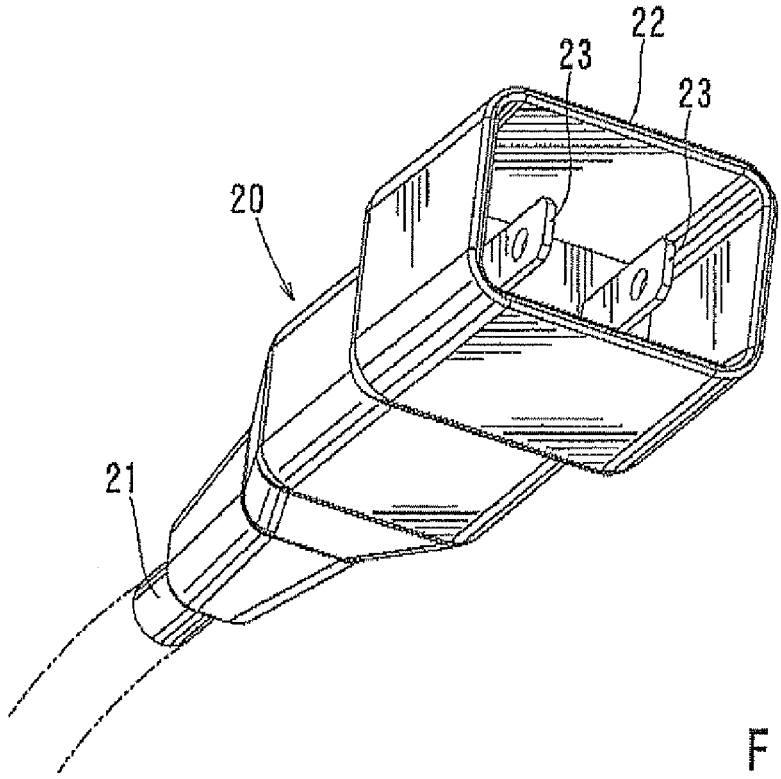
FIG. 2 is a perspective view of a plug or a male connector.

Each of the additional features and teachings disclosed above and below may be utilized separately or in conjunction with other features and teachings to provide an improved connecting device. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one example, a connecting structure for connecting two electric cords to each other includes a male connector and a female connector. The male connector has a connecting cover portion and is connected one of the two electric cords. The female connector has a lock mechanism and is connected to the other of the two electric cords. The female connector can be connected to the male connector by inserting the female connector into the connecting cover portion of the male connector in a connecting direction and the connected condition can be locked by the lock mechanism. An unlock button can unlock the lock mechanism and is provided to the female connector at a position rearward of an end portion of the connecting cover portion with respect to the connecting direction.

With this arrangement, waterproof function of the cover may not be impaired when the male and female connectors are connected to each other because the connecting cover portion on the female connector side can be prevented from being deformed due to interference of the connecting cover portion with the unlock button of the female connector.

Therefore, it is possible to connect the female connector to the male connector without impairing mainly the waterproof function of the connecting cover portion. In addition, the lock mechanism can securely perform its function because it is possible to avoid an inadvertent operation of the unlock button.

The one of the electric cords may be a power cord provided on a side of an electric device and the other of the electric cords may be an extension cord. For example, the electric device may be a lawn mower.

In this case, it is possible to achieve a remarkable effect when applied to an electric device, which has a power cord having a length of about 30 cm in general.

The unlock button may have a substantially semi-circular shape with a flat front side and an arc-shaped rear side, and the flat front side may be opposed to the end portion of the connecting cover portion for avoiding interference of the connecting cover portion with the unlock button.

With this arrangement, it is possible to securely avoid the interference of the connecting cover portion with the unlock button without impairing the operability of the unlock button. Therefore, versatility of the connecting structure can be further improved because connecting cover portions having different depths can be applied.

In another example, the unlock button is covered with a waterproof cover having a waterproof function for an interior of the female connector. With this arrangement, a waterproof performance for the female connector can be further improved.

In another example, the unlock button is provided at a side portion of the female connector so as to be capable of being pressed into the female connector. The connected condition of the male connector with the female connector can be unlocked by pressing the unlock button. The unlock button has a finger contact portion, with which finger tips of a user cart contact during an unlock operation of the unlock button. The unlock button is inclined such that a height from the side portion of the female connector becomes higher toward a rear side with respect to the connecting direction of the female connector with the male connector.

With this arrangement, a function of preventing slippage in a removal direction of the female connector can be provided to the finger contact portion of the unlock button. Therefore, the female connector can be easily removed from the male connector while the unlock button is operated to perform an unlock function. As a result, it is possible to improve the operability (easiness of handling) of the female connector.

The unlock button may protrude from a side surface of the connector when the unlock button is not operated, and a protruding distance of the unlock button is determined so that the unlock button protrudes laterally beyond the connecting cover portion when the female connector is connected with the male connector. With this arrangement, it is possible to improve the operability of the unlock button during the unlock operation.

An example will now be described with reference to FIGS. 1 to 5. FIG. 1 shows a female connector 10 according to an example. The female connector 10 can be connected to a plug (hereinafter called "male connector") 20 shown in FIG. 2. The male connector 20 is attached to an and portion of a power cord 21 of a gardening tool (not shown), such as a lawn mower. The female connector 10 is attached to an end portion of an extension cord 11 for extending the power cord 21 of the gardening tool. The power cord 21 of the gardening tool can be extended with the extension cord 11 by connecting the female connector 10 to the male connector 20. In this aspect, the power cord 21 of the gardening tool and the extension cord 11 may be referred to as two electric cords, which are to be connected with each other. The male connector 20 has a connecting cover portion 22 and is provided to the power cord 21. The female connector 10 has a lock mechanism 30 and is provided to the extension cord 11.

The connecting cover portion 22 mainly has a waterproof function and is disposed at the front end of the male connector 20. The connecting cover portion 22 is configured to have a rectangular tubular body. Connecting terminals 23 are received within the connecting cover portion 22. The depth of the connecting cover portion 22 is so determined that both connecting terminals 23 do not project beyond the connecting cover portion 22. When the end portion of the female connector 10 is inserted into an inner side of the connecting cover portion 22, the connecting terminals 23 are electrically connected to the connecting terminals 13 of the female connector 10 so that the electric power can be supplied.

Figure 4:
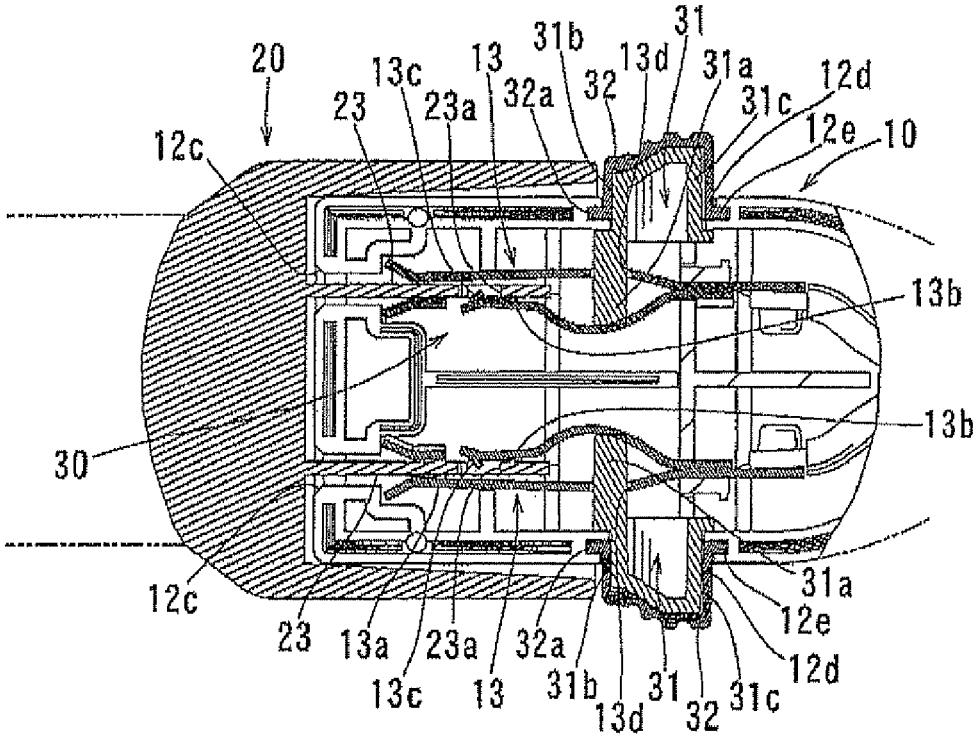
FIG. 4 is a cross sectional view of the female and male connectors in a connected condition.

The female connector 10 includes a housing 12, which is formed to have a structure split into two portions, i.e., an upper housing 12*a* and a lower housing 12*b*. When the upper housing 12*a* and the lower housing 12*b* are connected with each other such that the upper housing 12*a* is placed on the lower housing 12*b*, two insertion holes 12*c* are formed at the end surface of the housing 12. The connecting terminals 23 of the male connector 20 are inserted into the two insertion holes 12*e*. The connecting condition between the female connector 10 and the male connector 20 is locked by the lock mechanism 30. The details of the lock mechanism 30 are shown in FIG. 4.

The connecting terminals 13 are positioned within the female connector 10 at the rear portions of the insertion holes 12*c*. Each of the connecting terminals 13 has a bifurcated structure including a base plate portion 13*a* and a pressure plate portion 13*b*, which are divided to left and right with respect to a direction of thickness of the connecting terminal 13. As shown in FIG. 4, each of the connecting terminals 23 of the male connector 20 is inserted between the base plate portion 13*a* and the pressure plate portion 13*b* so as to be connected thereto. The base plate portion 13*a* and the pressure plate portion 13*b* have resiliency in directions for clamping the connecting terminal 23 of the male connector 20 (i.e., directions toward each other).

An engaging claw portion 13*c* is formed on each of the left and right pressure plate portions 13*b*. The engaging claw portion 13*c* can engage an engaging hole 23*a* formed in each of the connecting terminals 23 of the male connector 20, so that the positional displacement of the engaging claw portion 13*c* in a removal direction is restricted to the result that the connected condition of the female connector 10 to the male connector 20 is locked. As shown in FIG. 4, because both engaging claw portions 13*c* are formed to be inclined toward the rear side, the connecting terminals 23 are each allowed to be inserted between the base plate portion 13*a* and the pressure plate portion 13*b* when the female connector 10 is connected.

This locked connecting condition can be released by pressing unlock buttons 31, which have covers and are provided at the left and right side portions of the housing 12. The unlock buttons 31 protrude laterally away from the left and right side portions of the housing 12.

Figure 3:
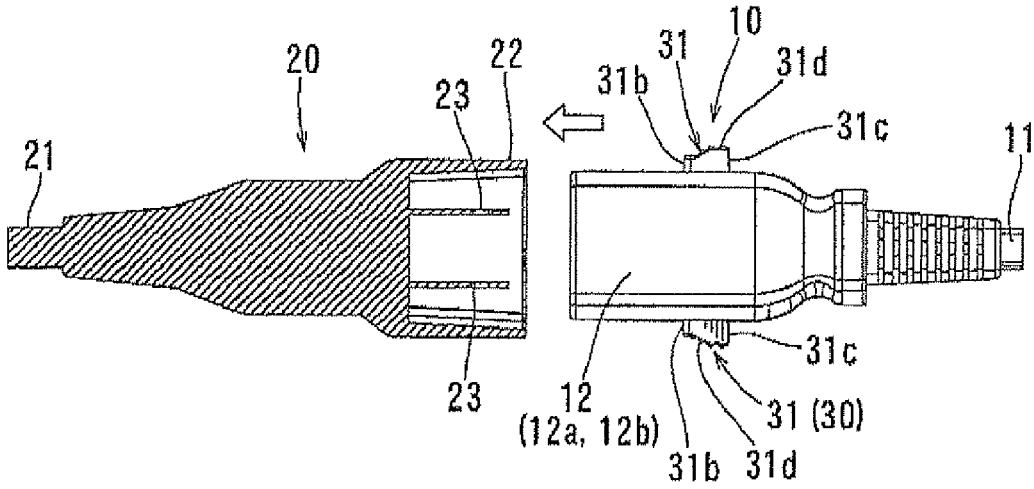
FIG. 3 is a plan view of the female and male connectors before connection to each other and showing the male connector in a horizontal sectional view.

As shown in FIG. 4, the unlock buttons 31 are disposed in such positions that they are not interfered with the end portion of the connecting cover portion 22 when the end side of the female connector 10 is inserted into and connected to the connecting cover portion 22 of the male connector 20. The direction indicated by an outline arrow in FIG. 3 is a connecting direction of the female connector 10 to the male connector 20. More specifically, when the female connector 10 has been connected to the connecting cover portion 22 of the male connector 20, both unlock buttons 31 are positioned on the rear side of the connecting cover portion 22 with respect to the connecting direction not to be interfered with the connecting cover portion 22.

As shown in FIG. 1, both unlock buttons 31 have a substantially semi-circular configuration as viewed from a lateral side. Front sides of the unlock buttons 31 with respect to the connecting direction are formed as flat surfaces 31*b*, which are perpendicular to the connecting direction, and rear sides of the unlock buttons 31 with respect to the connecting direction are formed as semicircular arc-shaped surfaces 31*c*. In the connecting state, the flat surfaces 31*b* are opposed to and spaced from the end portion of the connecting cover portion 22 so that potential interference of the connecting cover portion 22 with the unlock buttons 31 can be avoided.

Further, finger contact portions 31*d* of the left and right unlock buttons 31 are inclined in directions such that their heights on the rear side are higher than on the front side. As a result, a force in a pull-out direction (toward the rear side) can be easily applied when the operator pulls the female connector 10 out from the male connector 20 while pressing both unlock buttons 31. Therefore, excellent operability can be ensured when pressing the unlock buttons 31 and pulling out the female connector 10. In addition, ribs are provided to the finger contact portions 31*d* for the purpose of preventing slippage of fingers.

Each of the unlock buttons 31 includes an operative arm portion 31*a*, which extends into the interior of the housing 12. The operative arm portion 31*a* extends through an insertion hole 13*d* formed in the base plate portion 13*a* of one of the connection terminals 13 and abuts the pressure plate portion 13*b*. Consequently, when the left and the right unlock buttons 31 are pressed to move toward each other, the operative arm portions 31*a* move toward each other in conjunction with the movement of the unlock buttons 31. As a result, the pressure plate portions 13*b* of both connecting terminals 13 are pressed to move toward each other.

Because the pressure plate portions 13*b* move away from the connecting terminals 23 of the male connector 20 as the pressure plate portions 13*b* of both connecting terminals 13 are pressed to move toward each other, the engaging claw portions 13*c* are removed from the engaging holes 23*a*. Then, each of the connecting terminals 23 of the male connector 20 is allowed to be removed from between the base plate portion 13*a* and the pressure plate portion 13*b* as the engaging claw portion 13*c* is removed from the engaging hole 23*a*. Therefore, the female connector 10 can be removed from the plug 20.

If the pressing operation of the unlock buttons 31 are released, the unlock buttons 31 are returned in such directions that the unlock buttons 31 protrude laterally from the housing 12 due to the resilient forces of the pressure plate portions 13*b*. When both unlock buttons 31 are not operated, the unlock buttons 31 protrude laterally beyond the connecting cover portion 22 of the male connector 20, which enables easy pressing operations of the unlock buttons 12 (unlock operation of the lock mechanism) when required after that.

Figure 5:
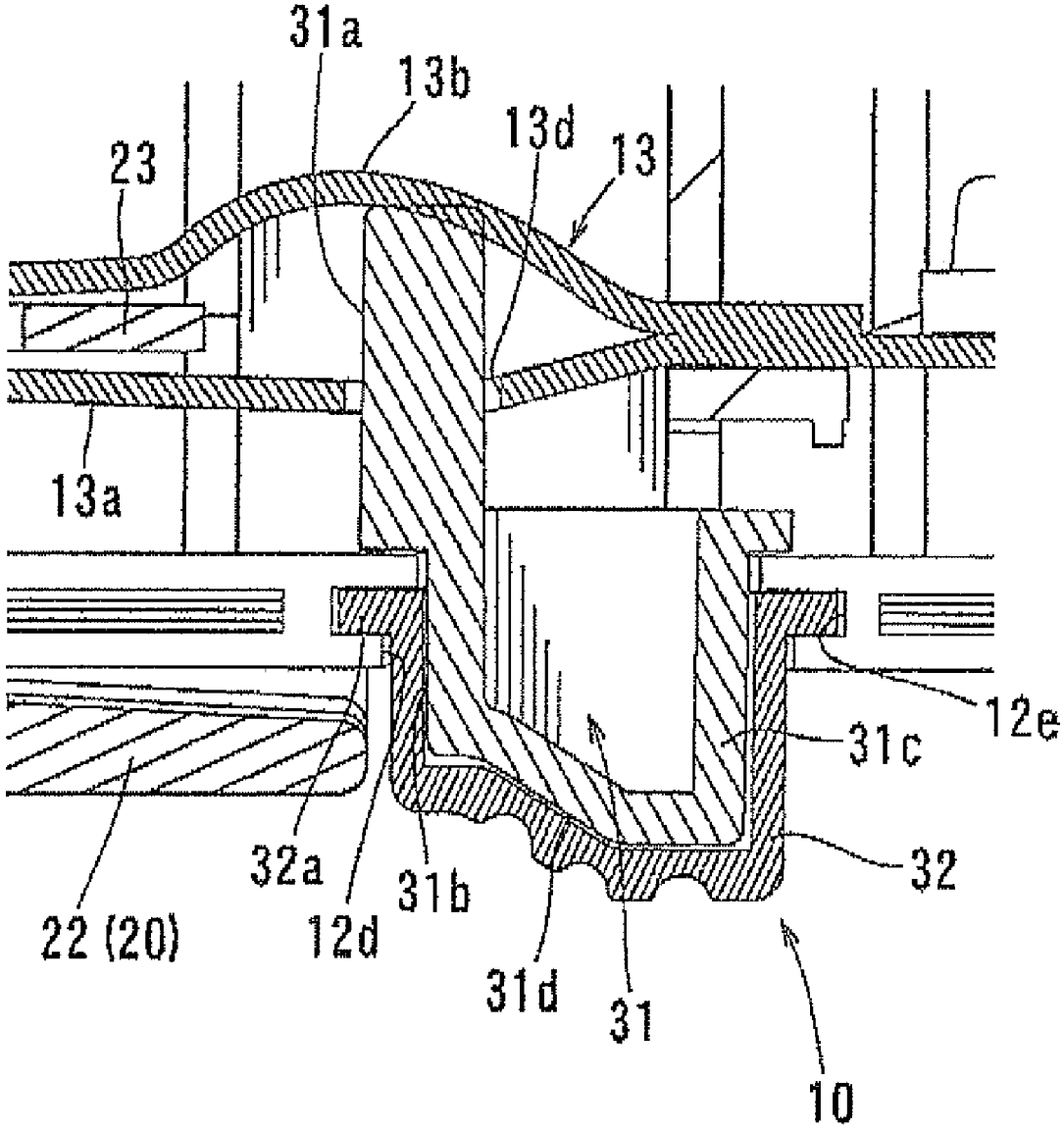
FIG. 5 is an enlarged cross sectional view of an unlock button and its surrounding region.

As shown in FIGS. 4 and 5, both unlock buttons 31 are respectively entirely covered with waterproof covers 32. Potential clearance around the unlock buttons 31 at opening portions 12*d* of the left and right sides of the housing 12 can be waterproofed by the waterproof covers 32. Flange portion 32*a* are respectively integrally formed with the waterproof covers 32. Each of the flange portions 32 is inserted into a recess portion 12*e*, which is formed along the entire circumference of the corresponding opening portion 12*d* in order to waterproof the circumference of the unlock buttons 31.

According to the connector 10 configured as described-above, the positions of the unlock buttons 31 are determined to be on the rear side with respect to the connecting direction of the connecting cover portion 22 in the state that the female connector 10 is connected to the male connector 20, and therefore, the connecting cover portion 22 of the male connector 20 does not interfere with the unlock buttons 31. Thus, the lock mechanism 30 and the unlock buttons 31 for the female connector 10 can reliably perform their functions without impairing mainly the waterproof performance of the male connector 20 having the waterproof covers 32. Further, with this connecting structure of the male connector 20 of the power cord 21 and the female connector 10 of the extension cord 11, both waterproof function and the connecting lock function can be reliably performed. In this way, the unlock buttons 31 are positioned at on the side of the rear portion of the female connector 10 in consideration of the relative positional relationship with the connecting cover position 22 on the side of the male connector 20, and therefor; it is possible to improve the versatility with respect to connection of the female connector 10 to enable connection to various male connectors (plugs) having connecting cover portions with different depths.

Furthermore, because the front portion of each of the left and right unlock buttons 31 is formed to have the flat surface 31*b*, it is not necessary to position the unlock buttons 31 unnecessarily backward with respect to a connecting direction.

The left and right unlock buttons 31 are respectively covered with the waterproof covers 32 providing waterproof for the interior of the female connector 10. In addition, because the flange portion 32*a* of each of the waterproof covers 32 is inserted into the recess portion 12*e* of the corresponding opening portion 12*d*, it is possible to further improve the waterproof performance around the unlock buttons 31.

The finger contact portions 31*d* of the left and right unlock buttons 31 are inclined such that their heights on the rear side are higher than on the front side with respect to the connecting direction, and therefore, the operative force in a pressing direction and the operative force in a removing direction of the female connector 10 can be easily applied to the unlock buttons 31 in a balanced manner. Therefore, the operator can easily pull out the female connector 10 from the male connector 20 while pressing the unlock buttons 31.

The heights of the left and right unlock buttons 31 are determined so that the left and right unlock buttons 31 protrude laterally beyond the side surface of the connecting cover portion 22 when the unlock buttons 31 are not operated. Therefore, the operability for unlocking the lock mechanism 30 (i.e., for pressing the unlock buttons 31) can be improved.

Further, it is not necessary to attach hooks respectively on the power cord side and the extension cord side and connect with, for example, the string between both hooks in order to lock the connected condition as in the conventional connecting structures. The connected condition of the female connector 10, which is inserted into the connecting cover portion 22, may be automatically locked and this connection lock condition can be unlocked by a simple operation. Therefore, it is possible to remarkably improve the operability in this regard.

Various modifications may be made to the above-described aspects. For example, although a power cord for a gardening tool was exemplified in the above example, the above teaching can be broadly applied to connecting structures between extension cords and power cords of the other types of electric tools or electric devices in general.

Further, the above teaching can be also applied to a connecting structure, in which a female connector with a lock mechanism is provided to a power cord on the side of an electric device and a male connector (plug) with a connecting cover portion is provided on the side of an extension cord, into which the connector is inserted. In this specification, the term "male connector" (plug) is used to mean a connector having connecting terminals exposed to the outside and term "female connector" is used to mean a connector having insertion holes for receiving the connecting terminals of the male connector and having connection terminals disposed within the insertion holes for electrical connection with the connection terminals of the male connector.

This invention claims:

1. A connecting structure for connecting two electric cords to each other, comprising:

a male connector having a connecting cover portion and connected one of the two electric cords, a female connector having a lock mechanism and connected to the other of the two electric cords, the lock mechanism being configured to lock terminals of the male connector; and wherein the female connector can be connected to the male connector by inserting the female connector into the connecting cover portion of the male connector in a connecting direction and the connected condition can be locked by the lock mechanism; and an unlock button provided to the female connector and capable of unlocking the lock mechanism, the unlock button protruding laterally outward from the female connector in a direction substantially perpendicular to the connecting direction;

wherein the connecting cover portion has a rear end portion with respect to the connecting direction of the female connector;

wherein when the female connector is connected of the male connector, the unlock button is located at a position rearward of the rear end portion of the connecting cover portion with respect to the connecting direction, wherein the unlock button has a front surface positioned opposed to and proximal to the rear end portion of the connecting cover portion at least when the female connector is connected to the male connector.

2. The connecting structure as defined in claim 1, wherein the unlock button has a flat front side and an arc-shaped rear side, the flat front side defining the front surface and extending in a direction substantially perpendicular to the connecting direction, and the arc-shaped rear side being inclined outwardly in a rearward direction opposite to the connecting direction.

3. The connecting structure as defined in claim 1, wherein the unlock button comprises a pair of unlock buttons positioned on opposite lateral sides of the female connector.

4. A connector used for the connecting structure as defined in claim 1, wherein the unlock button is covered with a waterproof cover having a waterproof function for an interior of the connector.

5. The connecting structure as defined in claim 1, wherein the unlock button is provided at a side portion of the female connector so as to be capable of being pressed into the female connector;

wherein the connected condition of the male connector with the female connector can be unlocked by pressing the unlock button; and wherein the unlock button has a finger contact portion, with which finger tips of an user can contact during an unlock operation of the unlock button, the unlock button being inclined such that a height from the side portion of the female connector becomes higher toward a rear side in the connecting direction of the female connector with respect to the male connector.

6. The connecting structure as defined in claim 1, wherein the unlock button protrudes from a side surface of the connector when the unlock button is not operated, and a protruding distance of the unlock button is determined so that the unlock button protrudes laterally beyond the connecting cover portion when the female connector is connected with the male connector.

7. A connecting structure for connecting an extension cord to a power cord, comprising:

a male connector having a connecting cover portion and connected to the power cord;

a female connector having a lock mechanism and connected to the extension cord, the lock mechanism being configured to lock terminals of the male connector, wherein the female connector can be connected to the male connector by inserting the female connector into the connecting cover portion in a connecting direction and the connected condition can be locked by the lock mechanism; and an unlock button provided to the female connector and capable of unlocking the lock mechanism, the unlock button protruding laterally outward from the female connector in a direction substantially perpendicular to the connecting direction;

wherein the connecting cover portion has a rear end portion with respect to the connecting direction of the female connector;

wherein when the female connector is connected to the male connector, the unlock button is located at a position rearward of an end portion of the connecting cover portion with respect to the connecting direction, wherein the unlock button has a front surface positioned opposed to and proximal to the rear end portion of the connecting cover portion at least when the female connector is connected to the male connector.

8. The connecting structure as defined in claim 7, wherein the unlock button has a flat front side and an arc-shaped rear side, the flat front side defining the front surface and extending in a direction substantially perpendicular to the connecting direction, and the arc-shaped rear side being inclined outwardly in a rearward direction opposite to the connecting direction.

9. The connecting structure as defined in claim 7, wherein the unlock button comprises a pair of unlock buttons positioned on opposite lateral sides of the female connector.

10. A connector used for the connecting structure as defined in claim 7, wherein the unlock button is covered with a waterproof cover having a waterproof function for an interior of the connector.

11. The connecting structure as defined in claim 7, wherein the unlock button is provided at a side portion of the female connector so as to be capable of being pressed into the female connector;

wherein the connected condition of the male connector with the female connector can be unlocked by pressing the unlock button; and wherein the unlock button has a finger contact portion, with which finger tips of an user can contact during an unlock operation of the unlock button, the unlock button being inclined such that a height from the side portion of the female connector becomes higher toward a rear side in the connecting direction of the female connector with respect to the male connector.

12. The connecting structure as defined in claim 7, wherein the unlock button protrudes from a side surface of the connector when the unlock button is not operated, and a protruding distance of the unlock button is determined so that the unlock button protrudes laterally beyond the connecting cover portion when the female connector is connected with the male connector.

13. An electrical connection device comprising:

a first connector:

a second connector capable of being mechanically and electrically connected to the first connector;

a lock mechanism capable of locking the connection between the first and second connectors;

wherein the first connector has a cover capable of covering a connecting region between the first and second connectors; and wherein the second connector has an unlock device operable to unlock the lock mechanism;

wherein the unlock device is positioned not to interact with the cover when the first and second connectors are connected to each other;

wherein the unlock device comprises an unlock button mounted to the second connector and protruding from a lateral surface of the second connector, wherein the unlock button can move from a first protruding position to a second protruding position for unlocking the lock mechanism;

wherein the unlock button is covered with a waterproof cover; and wherein the waterproof cover is fixedly attached to the unlock button so that the waterproof cover moves together with the unlock button relative to the second connector.

14. The electrical connection device as in claim 13, wherein the unlock button is directly opposed to an end portion of the cover when the first and second connectors are connected to each other.

15. The electrical connection device as in claim 14, wherein the unlock button is spaced from the end portion of the cover when the first and second connectors are connected to each other.

16. A connecting structure for connecting two electric cords to each other, comprising:

a male connector having a connecting cover portion and connected one of the two electric cords, a female connector having a lock mechanism and connected to the other of the two electric cords; and wherein the female connector can be connected to the male connector by inserting the female connector into the connecting cover portion of the male connector in a connecting direction and the connected condition can be locked by the lock mechanism; and an unlock button provided to the female connector and capable of unlocking the lock mechanism;

wherein the connecting cover portion has a rear end portion with respect to the connecting direction of the female connector;

wherein when the female connector is connected to the male connector, the unlock button is located at a position rearward of the rear end portion of the connecting cover portion with respect to the connecting direction; and wherein the unlock button has a flat front side and an arc-shaped rear side, the flat front side extending in a direction substantially perpendicular to the connecting direction, and the arc-shaped rear side being inclined outwardly in a rearward direction opposite to the connecting direction, and the flat front side being opposed to the end portion of the connecting cover portion for avoiding interference of the connecting cover portion with the unlock button.

17. A connecting structure for connecting an extension cord to a power cord, comprising:

a male connector having a connecting cover portion and connected to the power cord;

a female connector having a lock mechanism and connected to the extension cord;

wherein the female connector can be connected to the male connector by inserting the female connector into the connecting cover portion in a connecting direction and the connected condition can be locked by the lock mechanism; and an unlock button provided to the female connector and capable of unlocking the lock mechanism;

wherein the connecting cover portion has a rear end portion with respect to the connecting direction of the female connector;

wherein when the female connector is connected to the male connector, the unlock button is located at a position rearward of an end portion of the connecting cover portion with respect to the connecting direction; and wherein the unlock button has a flat front side and an arc-shaped rear side, the flat front side extending in a direction substantially perpendicular to the connecting direction, and the arc-shaped rear side being inclined outwardly in a rearward direction opposite to the connecting direction, and the flat front side being opposed to the end portion of the connecting cover portion for avoiding interference of the connecting cover portion with the unlock button.

* * * * *